United States Patent [19]

Lambert, Jr.

[11] 4,200,279

[45] Apr. 29, 1980

[54] LEG EXTENSION, LEG CURL, HIP, THIGH, BACK AND BUTTOCKS MACHINE

[76] Inventor: Lloyd J. Lambert, Jr., Dynamics Health Equip. Mfg. Co. Inc., 1538 College Ave., South Houston, Tex. 77587

[21] Appl. No.: 893,615

[22] Filed: Apr. 5, 1978

[51] Int. Cl.[2] ..... A63B 21/00

[52] U.S. Cl. ..... 272/118; 272/134

[58] Field of Search ..... 272/118, 117, 130, 131, 272/132, 116, 134; 128/25 R, 25 B

[56] References Cited

U.S. PATENT DOCUMENTS

| | | | |
|---|---|---|---|
| 684,688 | 10/1901 | Herz | 272/117 |
| 3,912,261 | 10/1975 | Lambert, Sr. | 272/134 X |
| 3,998,454 | 12/1976 | Jones | 272/117 |

OTHER PUBLICATIONS

"Time Machines by Nautilus" insert pp. 41–72 to Iron Man Jul. 1973.

*Primary Examiner*—Richard J. Johnson

*Attorney, Agent, or Firm*—Victor J. Evans & Co.

[57] ABSTRACT

Disclosed herein are devices which are characterized in their ability to isolate a specific lower body muscle and by working against weights through a system of pulleys and cams, provide concentrated development of that specific lower body muscle. The mechanisms described hereinafter include a place to accommodate the machine user, a substantially cylindrical cushioned element oriented for engagement by the users legs, and a cable and gearing network including chain and cam and pulley mechanisms associated with weights the magnitude of which are selectable so that the work done against the weights focuses on a specific lower body muscle depending upon the orientation of the user and additionally provides an orientation of the weights relative to the user such that any sudden release of the load or work being done against the weights can in no way engage and harm the user.

5 Claims, 6 Drawing Figures

FIG. 4
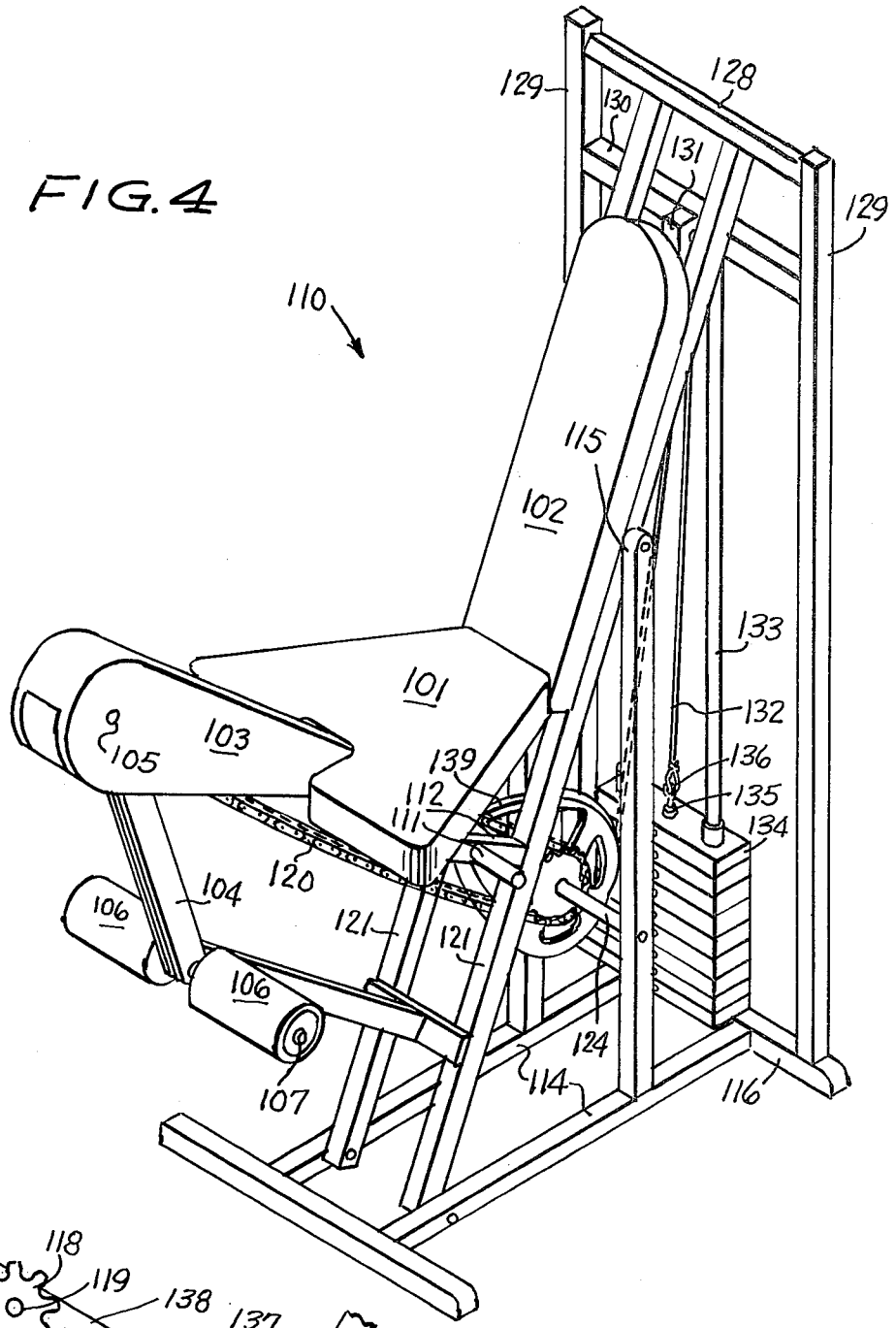
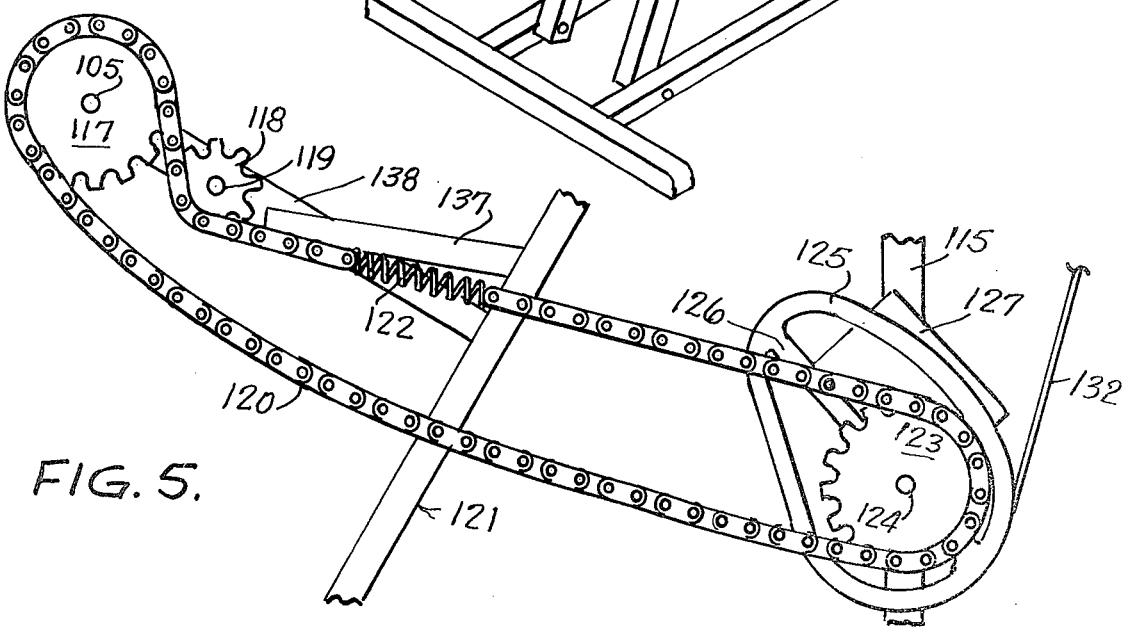
FIG. 5.

LEG EXTENSION, LEG CURL, HIP, THIGH, BACK AND BUTTOCKS MACHINE

BACKGROUND OF THE INVENTION

1. Field of the Invention

The art of weight lifting has progressed and increased in popularity remarkably over the last few years, and along with this increase in popularity there has been a greater regard for the safety of the people who utilize this machinery. Traditional lower torso machinery which works not only the legs but the buttocks thigh and hip and lower back areas generally consisted of deep knee bends with weights, leg lifts, or a bench upon which a person is disposed and the weight bar is oriented overhead in a trackway in such a manner that when the legs of the person using the machine pushed upon the bar, work would be done against the weights in a vertical sense. The problems associated with this type of machinery for legs and lower back included that the fear of using this machine unattended, since an inordinate or excessive amount of weight could cause the persons leg to be folded against his chest, and therefore be unable to move from underneath the weights. The shortcomings associated with the leg lift or the deep squats included lose of balance and perhaps pulling a muscle which would cause the weight to be dropped rapidly increasing the likelihood of the user injuring himself.

In addition, the science of weight lifting has developed to the point where specific machines have been developed to exercise specific muscles in the lower torso. To this end, the body member to be exercised is constrained so that it can only move in one direction, thereby assuring that the muscle to be developed is worked, and the likelihood of cheating on the weight lifting, by calling other muscles into play, has been minimized.

Accordingly, disclosed herein are weight lifting machines specifically designed for the lower torso in which muscles desired to be developed are worked substantially to the exclusion of every other muscle.

In addition the following detailed specification will provide a teaching wherein a minimum amount of supervision when using the machine is afforded, since the machines are extremely safe to use and provide no hazard whatsoever to the weight lifter.

Further disclosed herein are machines which make attractive and relatively easy the working of specific lower torso muscles.

Other objects and advantages will become apparent in the following specification when considered in light of the attached drawings.

BRIEF DESCRIPTION OF THE DRAWINGS

FIG. 4 is directed to a leg extension machine;

FIG. 5 shows the linkage of the machine in FIG. 4; and

DESCRIPTION OF THE PREFERRED EMBODIMENT

Figure 1:
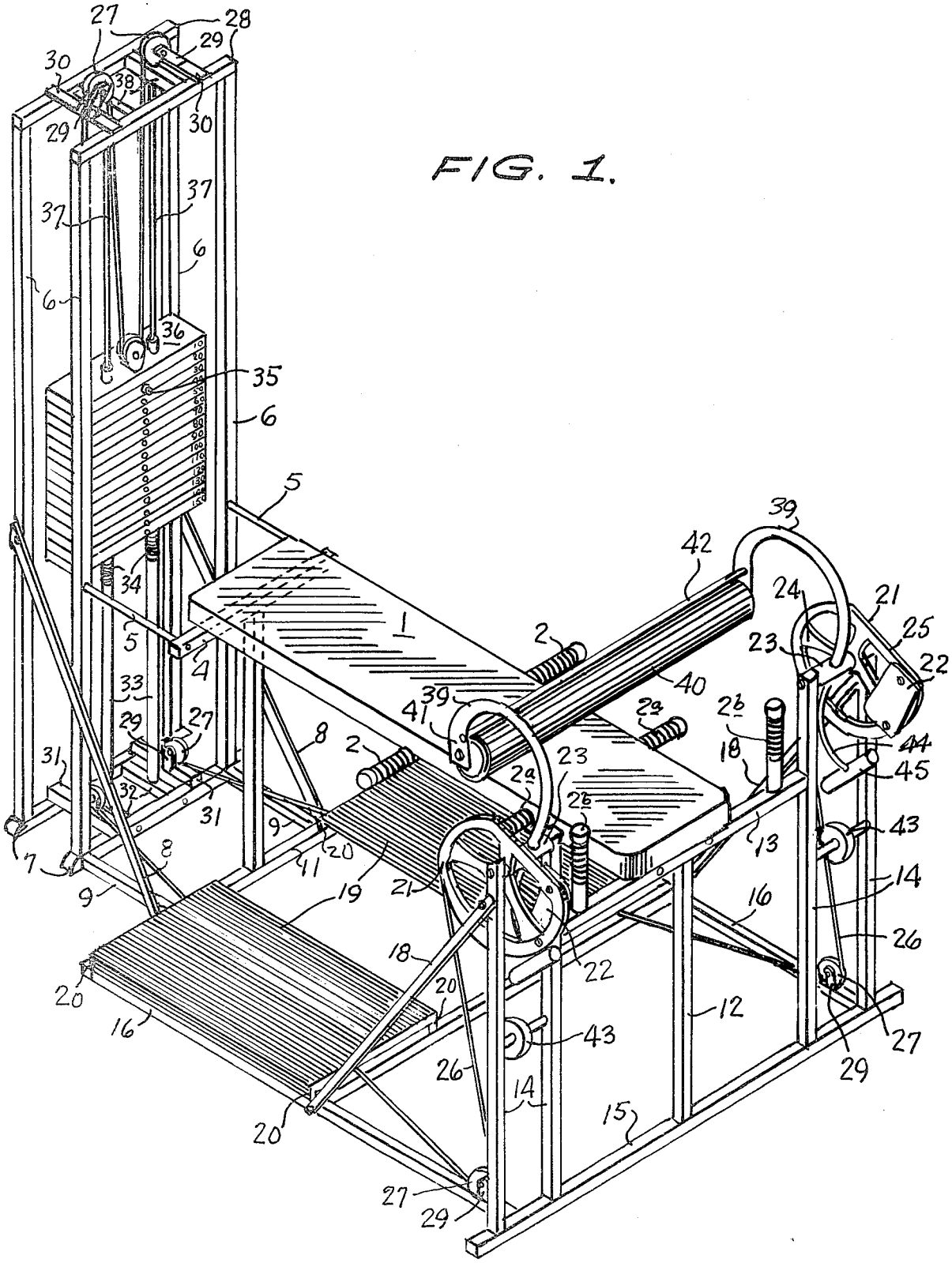
FIG. 1 is a perspective view of a hip, thigh, back, and buttocks developing machine.
Figure 2:
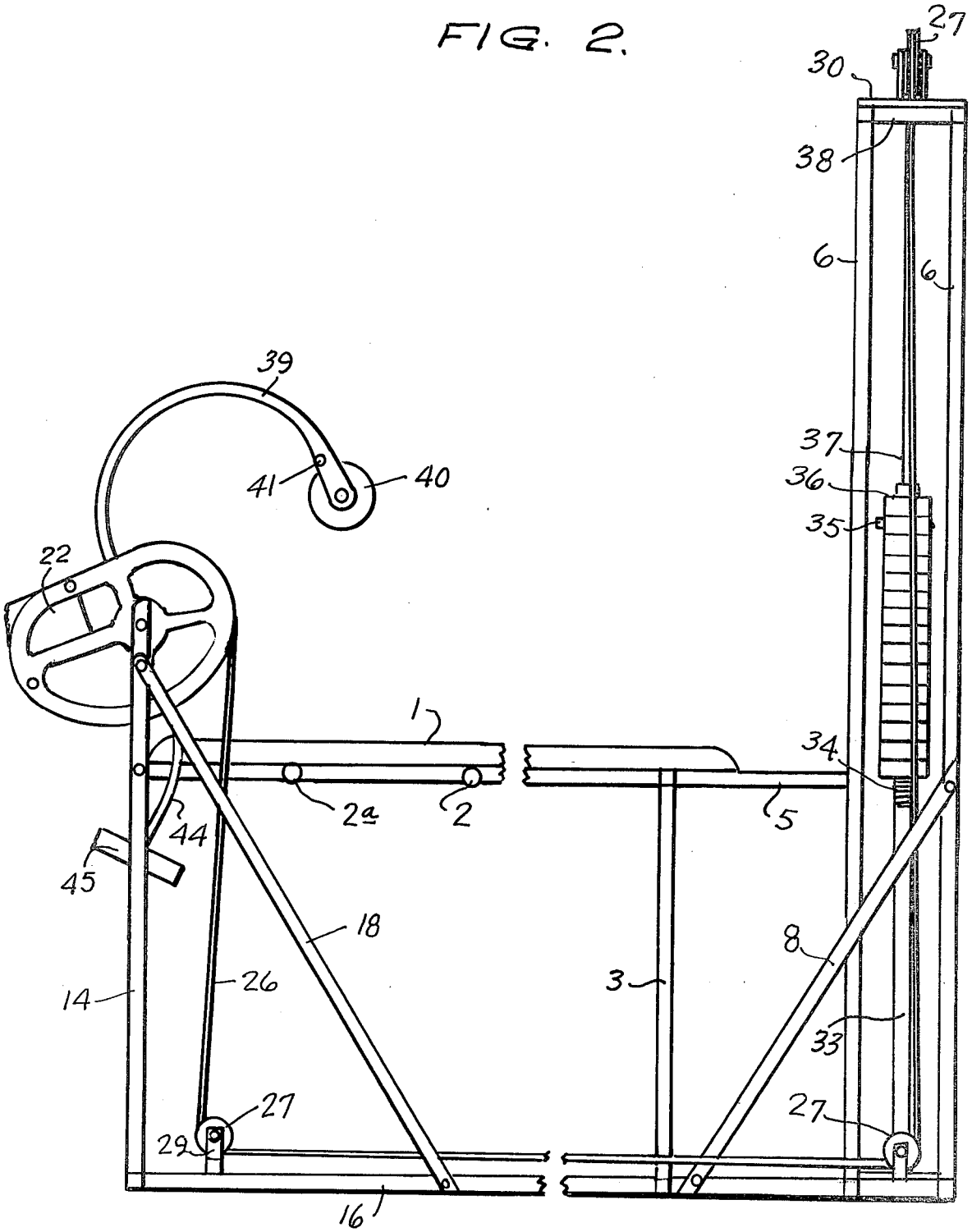
FIG. 2 is a side view thereof.
Figure 3:
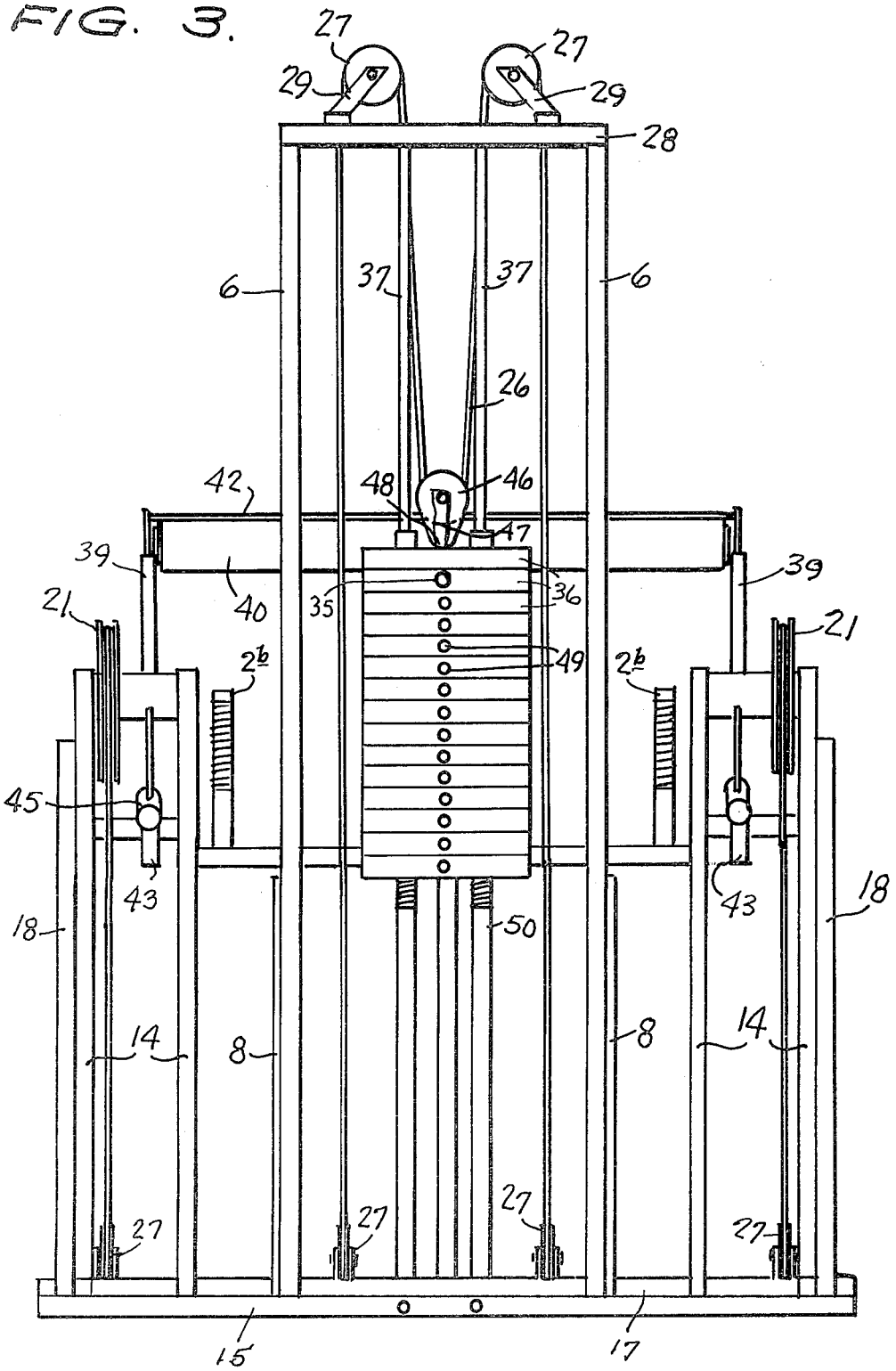
FIG. 3 is an end view of the apparatus according to FIG. 1 shown from the rear.

Referring to the drawings now wherein like reference numerals refer to like parts throughout the various drawings, reference numeral 10 is generally directed to the hip, thigh, back and buttocks machine according to FIGS. 1 through 3.

This machine can generally be regarded as having a horizontal bench 1 which has a substantially greater length than width and is supported at the extremities of its length by means of a cross bar 4 at one end and a cross bar 13 at another end. The bench 1 has two sets of hand grips 2 and 2A emanating outwardly therefrom in the width wise sense, and further the horizontal support bar 13 has two vertical additional hand grips 2B emanating vertically upward therefrom. The end remote from the vertical hand grips 2B as has been stated as supported by a cross bar 4 which extends width wise relative to the bench 1 and is supported by an upstanding vertical column 3 and also by horizontal support bars 5 connected to an additional framework which will be discussed hereinafter. The vertical support bar 3 terminates on the ground in a horizontal bar 11 parallel to bar 4 which serves to provide additional stability for the bench 1 and this bar 11 can be seen from the various drawings to form a rectangular grid when fastened to orthogonally disposed bars 16 which are directed towards and along the length of the bench 1 and bar member 15 which is parallel to bar 11 thereby forming a rectangle grid. The second vertical cross bar 12 connected to horizontal bar 13 supporting bench 1 is connected to this framework at bar 15 substantially medially along the extent of bar 15. An additional bar 17 is disposed in parallel relationship to bars 11 and 15 substantially medially along the length of bars 16 and is used to support platform shrouds 19 which are vertically raised from this floor grid by means of feet 20 and the purpose for raising these platforms will be explained shortly.

The juncture of bars 16 to 15 are such that there is a portion of bar 15 extending outwardly relative to each bar 16 and there is further provided upstanding vertically disposed support bars 14 equi distant on either side of bars 16 so that as shown in the drawings there are a total of four vertically upstanding bars 14. At the extremity remote from this base or rectangular grid and horizontal to bar 15 these two pairs of bars 14 are connected by a pin in which slidably displaced thereover is a sleeve member 23. The sleeve member 23 serves to support a generally D-shaped cam 21 and this cam is supported on the sleeve 23 by means of spokes 24 and the outer periphery of this D-shaped cam has a groove 25 extending around its outer periphery. One end of this cam has a plate member 22 disposed thereon and it is to be noted from the drawings there are two of these cams disposed on opposite sides of the bench 1. A cable 26 is attached to each cam and the course this cable 26 follows will be described in detail hereinafter. The sleeve 23 further supports a pair of arcuate elements 39 each of which is disposed on its respective sleeve 23 on opposed sides of the bench 1 and each arcuate element 39 is interconnected at the extremity remote from the sleeve 23 by means of a pair of bars 42 through a plate element 41. One of the bar members 42 has a roller 40 disposed thereon and this roller 40 is padded so as to provide a comfortable nesting surface for the legs of the person who uses this machine. Parallel to sleeve 23 and spaced substantially medially downward along vertical bars 14 are a pair of shafts having a roller abuttment 43 disposed thereon. Approximately diametrically opposed from the arcuate elements 39 are a second sets of arcuate elements 44 having an opposite sense from the first arcuate members 39 and these members terminate in counter balanced weights 45 so that the combination of elements 44 and 39 through sleeve 23 defines a generally S-shaped configuration. The rollers 43 disposed on the shaft medially disposed and parallel to the sleeve 23 form a stop member for arcuate elements 44 and the T-shaped counter balance is 45 connected thereto.

Following the cable 26 now it will be seen that from its fastened point along D-shaped cam 21 extends downwardly to the frame member 16 upon which it changes direction through pulley 27 which is supported on the pair of rods 16 by a U-shaped bracket 29 having a shaft thereon supporting the pulley 27. Thereafter the cable goes underneath the guards 19 and the purpose thereof is now evident since one getting on or getting off the bench 1 can use these guards 19 to assist this function and avoid the risk of getting entangled with the cable. The cable 26 thereafter goes to a second set of pulleys 27 similarly journalled by U-shaped support brackets 29 and the direction thereafter is changed from a substantially horizontal sense to a vertical one. These two pulleys are supported on block elements 31 and the block elements in turn are disposed at their opposed extremities by a pair of orthogonally disposed relative to the block 31 cross bars.

These cross bars 7 generally provide the foundation or fundamental support for the weights and additional pulleys and the like and the stability of this to be discussed system benefits from and relies upon being connected to the aforementioned and discussed machinery through parallel rod members 9 which extend from one foot or support bar 7 to the support bar 11 thereby defining a second rectangular grid, and the pair of support elements 7 have extending upwardly therefrom at their four extremities four vertical bars 6 having a substantially greater vertical extent than any other vertical bar discussed to date. These four vertical bars all have the same vertical extent and are supported and terminated by means of bar members 28 which are parallel to both bars 7 and these are further rigidified to a greater extent by cross bars 38 (relative to the bars 28, and to a lesser extent pulley support bars 30 at the upper extent, and to a greater extent cross bars 32, and to a lesser extent pulley support bars 31). Additional bracing includes providing the vertical bar 6 and the horizontal bars 9 with a cross brace extending therebetween so that all four of the vertical bars 6 are supported by these two cross bars 8 and are fastened at 9.

Returning therefore to the cable system 26 it has been stated that the cable changes from a horizontal direction to a vertical direction at pulley 27 in which the cross bar 31 supports the pulley through U-shaped bracket 29 and that there are two of these such cables. Thereafter these cables extend vertically upward to the top most or third set of pulleys also denoted by 27 and these are of course disposed upon the braces 30 discussed hereinabove and it is to be noted that the U-shaped brackets 29 have skewed angle when compared to the previously noted brackets so that the legs of the U-shaped bracket do not extend in a vertical sense but rather are somewhat offset inbetween a true horizontal and true vertical sense. The cables are wound around these top most pulleys 27 and extend vertically downwardly in a V-shaped configuration to the final pulley 46. This pulley 46 is shackled by an additional U-shaped bracket member 47 which terminates in a vertically disposed rod extending through weights 36. The weights 36 are generally regarded as thin rectangular solids and have holes 49 drilled through their width medially along the length of these rectangular solids so that a locking pin 35 can be inserted therein and engage the vertically depending shaft 48. It is to be noted that the vertically depending shaft 48 has a plurality of holes disposed therein so that in the free state such as shown in FIG. 3, the holes in depending shaft 48 are in registry with the holes 49 of the weights.

The weights 36 are supported on two parallel bar members 33 below the weights and these rods 33 are fastened firmly to block element 32 at its lower extent and proximate to the juncture of the weights to these rods 33 there are disposed springs overlying the rods 33 which have a step or shoulder portion which constrain and retard springs as shown by 50 of FIG. 3. The rods extend through the weights and upwardly and are fastened to the support bars 38 at their upper extremity, but it is to be noted that above the weights these support bars 37 have a somewhat thinner configuration than below the weights and therefore weights are constrained to ride up and down 37 as though it were a trackway. A sleeve element 51 is disposed around each of these upper rods to facilitate alignment.

Referring to FIGS. 4 and 5 now there is shown a leg extension machine which can be defined by the following components. A rectangular grid serves to support the structure. This grid is comprised of two parallel bars 114 interconnected by means of orthogonally disposed and parallel bars 113 and 116 which have a greater extent than the distance separating the two parallel bars 114 so that there is an overhang portion. Vertically extending upwardly from rearward bar 116 there are two vertically upstanding columns 129 having a cross bar 128 at its vertical extreme and a cross bar 130 slightly lower. Connecting cross bar 128 with the parallel bars 114 are a pair of diagonal bars 121 shown at the lower extremities being pin fastened to these bars 114. Extending substantially outward from these bars 121 a seat support member 112 serves to support seat 101, while the back portion of the seat 102 rests firmly against the two parallel diagonal braces 121. Below the seat is an additional cross bar 109 extending between the two bars 121 and extending outwardly away from the bars 121 is a stop member 108 whose purpose will be described hereinafter.

At the crotch of the seat 101 remote from the seat back 102 is a protective shroud 103 which is supported ultimately by the diagonal braces 121 through seat support 112 which, incidentally, also serves to provide a hand grip 111 on both sides of the seat. The shroud 103 has a pivot point 105 and extending therethrough is a rod member 104 and at the extremity remote from this pivot pin 105 is an axle 107 having cylindrical cushions 106 disposed on either side of the rod 104 which in the preferred embodiment is a rectangularly planar bar member. The cushions are free to rotate on shaft 107 and FIG. 5 gives a detailed depiction of the mechanism within the shroud 103 that communicates with a substantially D-shaped cam 125 and the connections to be described are as follows:

Emanating outwardly from the diagonal braces 121 are support shafts 138 and brace member 137 which serve to support gears 117 and 118 through pivot pins 105 and 119 respectively. The larger gear 117 serves to transfer the motion generated by the leg extension machine when the occupant sits in the seat and engages the cushions 106 on the top portion of the seat and attempts to extend his legs. Gear 118 serves as an idler or tensioning gear and transmits by rotation the work done on rod 104 to a chain 120. Chain 120 has a segment 122 composed of a spring and at the extremity of the chain remote from gear 117 is a third gear 123 pivoted on shaft 124. Shaft 124 is supported by means of vertical columns 115 disposed on either side at the back fastened to the diagonal braces 121 and the base support members 114. The shaft 124 may or may not rotate, but the interconnection of gear 123 with the D-shaped cam 125 is necessary to allow the work to be done. The spring 122 provides chain tension.

The D-shaped cam member has a groove disposed around its outer periphery denoted by reference numeral 139, and therefore the interconnection between the gear 123 and the cam 125 is such that the rotation of the gear necessitates a corresponding amount of rotation in the D-shaped cam 125. Connected to this cam is a cable 132 and the direction of travel of this cable will be discussed shortly. Going back, however, to the purpose of bar member 108, which serves as a stop for 106 bumper cushions and the pivoting rod 104, it is to be noted that the backward movement of this rod 104 is to be limited by stop member 108. Furthermore, the inclusion of a spring with the machine drive mechanism serves a dual function. It discourages the weight lifter from providing a sudden impulse in an attempt to lift a greater amount of weight than perhaps he is ready for, since any sudden impulses would tend to expand the spring rather than rotate the D-shaped cam and further provides an additional safety mechanism in that should the user quit on the machine and remove his legs, the abrupt removal of the counter exercising force would be somewhat dissipated by these springs.

The cable, it will be seen from FIG. 4, extends upwardly to cable support area 131 which changes the direction of the cable to translate a vertical sense and downward thereafter to a loop member 136, which is connected to a depending bar having an eyelet 135. The depending bar and eyelet 135 extend downwardly into a plurality of weights 134 of generally rectangular configuration and in a manner similar to the embodiments of FIGS. 1 through 3, the appropriate amount of weight can be chosen by inserting a rod into holes provided in the weights and the weights are constrained to ride on parallel rod members 133 in the vertically upward direction. Spring biasing is provided below the weights, as has been discussed in FIGS. 1 through 3.

Figure 6:
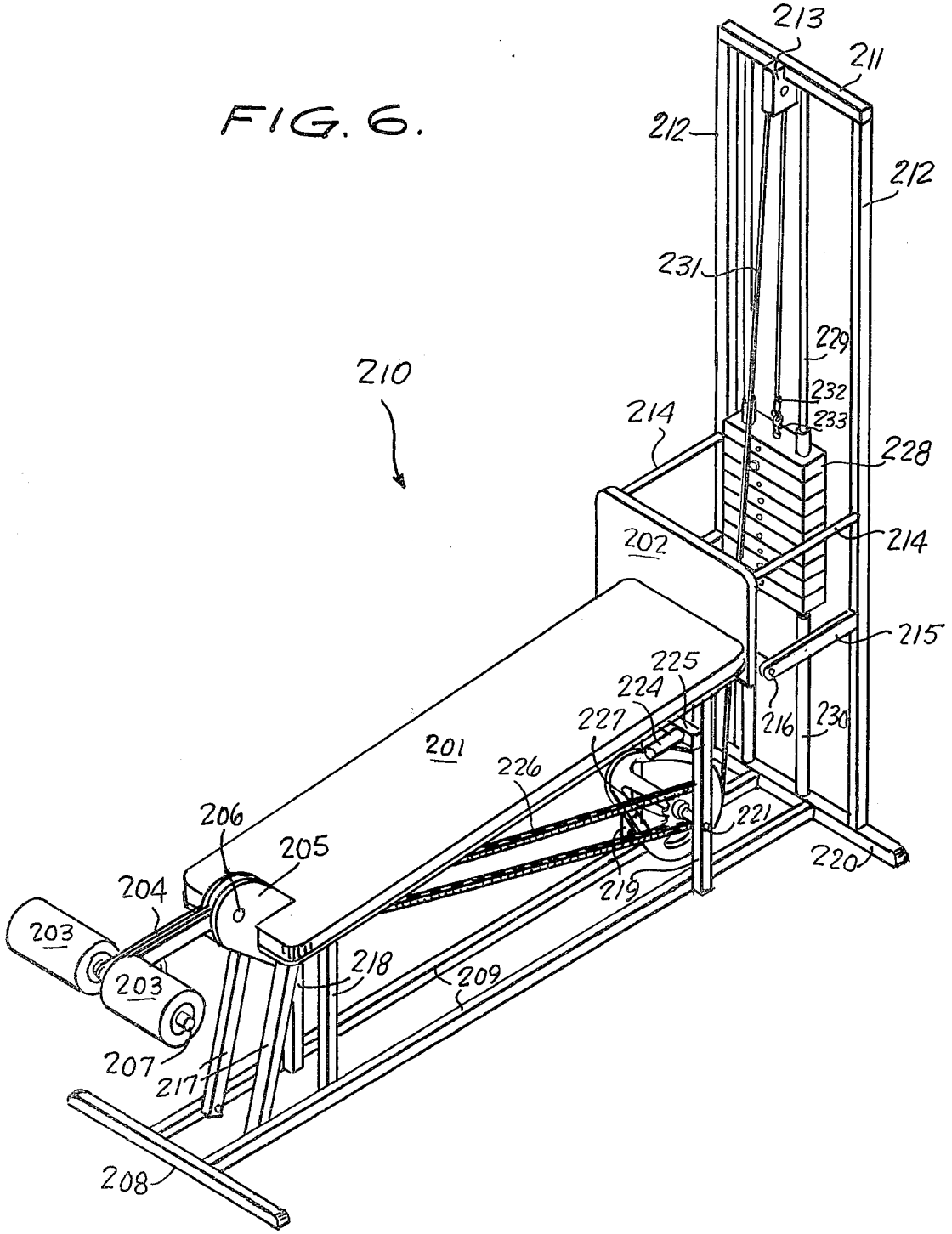
FIG. 6 is directed to a leg curl machine.

Referring to FIG. 6, now, the following briefly described items are given a cursory description since they have been deliniated in detail in the previous figures. The weights 228 are supported by upstanding vertical rods 230 having springs disposed between the weights and the rods, and a sleeve element translates vertically upward and downward with the weights along rods 229 as has been explained in FIGS. 1 to 3. In addition, the loop 232 and eye rod depending therefrom extending into the weights 235 perform similarly to do that which has been deliniated in FIGS. 4 and 5.

Cable 231 extends through pulley 213 and then downwardly around the D-shaped cam 222 which over-rides shaft 221 which has been also explained. Gear 227 travels with the D-shaped cam and a chain 226 having a spring suitably disposed thereon causes the D-shaped cam to rotate in a clockwise manner in response to the clockwise rotation of shaft 204. This is caused by placing the backs of the heels underneath cushion elements 203, supported on shaft 207, connected to rod 204 and pivoted about the point 206 which shows through the shroud 205. The weight user lies face down on horizontal bench 201, which has a head stop 202 orthogonally disposed to the bench 201, and the user holds onto hand grips 224 disposed below the horizontal bench 201 and supported on cross rod 225 which, in turn, is supported by vertical legs 219 that also serve to support one end of the bench and the shaft 221. The end of the bench proximate to the cushions 203 is supported by vertical legs 218 and somewhat diagonal braces 217 and all of these vertical and substantially vertical legs are connected to parallel bars 209 which run in the same sense as horizontal bench 201. The terminal extremities of rods 209 are fastened together by cross bars 208 and 220 and this latter cross bar has vertically upstanding columns 212 terminating in a cross bar 211 which serves to support pulley shroud 213.

The headboard 202 serves to isolate the user from the cable and is supported on the vertical columns 212 by means of round horizontally disposed support 214 and flattened lower support bars 215 which are pinned at 216 and connected to the back stop 202.

Having thus described the invention, it will be apparent that the apparatus according to FIG. 6 is utilized when a person is face down on horizontal bench 201 and his legs extend underneath the cushion rollers 203 and work is done and exercises are performed by rotating these cushion elements and the connecting linkages in a clockwise fashion. This is known as a leg curl.

FIGS. 4 and 5 show a leg extension exercise machine in which the user sits on seal 101, rests his back against back rest 102, holds onto hand grips 111, places his feet underneath the cushions 106 along the front face of the foot so that the heels extend backwardly to the weights and by extending his legs out and straightening them, will perform exercises that particularly develop the muscles along the upper thigh. It is to be noted that the machine of FIG. 6, is especially suited and adapted to work on the back muscles of the thigh.

FIGS. 1 through 3 are exemplary of the machine which can work on the hip, thigh, back and buttocks regions by having the user assume various positions on the bench 1. With the user on his back and his legs touching his chest and the cushion member 40 engaging the backside of the knee, extending this bar in a clockwise sense holding onto one of the three sets of hand grips that seem most comfortable, work is done not only on the lower abdomen, but also the buttocks. By lying face down on this machine and having the cushion bar 40 engage the front portions of the feet, work is done that will develop the back portion of the legs as well as the small of the back, and the buttocks. Incidentally, this machine could be conceivably used as a sit-up machine in which the bar engages the chest portion of the user and the exercise of the abdomen would be performed by attempting to sit up straight.

Having thus described the various preferred embodiments it will be apparent to those skilled in the art that numerous structural modifications are contemplated as being a part of this invention as set forth in the foregoing detailed description and as specified hereinbelow by the claims.

What is claimed is:

1. An exercise machine comprising in combination:

a first rectangular grid having a substantially medially disposed cross brace bar (17) interconnecting two members of said first grid, said first grid defining a bench support base, a pair of vertical support columns (3,12) disposed on two members (15,11) forming said grid not interconnected by said cross brace bar, medially disposed having vertical extremities provided with horizontal bar elements (4,13) parallel with the lower last named two members (15,11) said horizontal bar elements carrying thereon an horizontal bench, one of said last named two members (15) having two pairs of vertically disposed support bars (14) eminating therefrom at opposed extremities thereof for supporting cam means, said cam means comprising:

pins interconnecting each pair of support bars (14) remote from said first grid, a sleeve (23) thereover, a cam (21) on each sleeve having a substantially "D" shaped outer configuration and grooved on its outer periphery, spokes (24) connecting said outer periphery to a central portion of said cam, a plate member (22) on an outer portion of said cam to provide a first counterbalance, a second counterbalance connected to said sleeve defined by a first arcuate rod (44) connected to a cylindrical weight (45), a second arcuate rod (39) extending from said sleeve terminating in a plate member (41), the plate members from each second arcuate rod (39) interconnected by a pair of parallel bar members, one of which has a padded roller (40) thereon, a stop element between each pair of support bars (14) defined by a roller abuttment (43) to stop the arc of travel of said padded roller, cable means 26 attached to each said cam along its groove extending vertically downwardly to a pulley means (27) on said first grid, horizontally thereafter over said first grid to weight means, and two platforms (19) disposed on feet (20) supported by said first grid and cross brace bar (17) under which said cable means travel whereby a person using said exercise machine will be removed from said cable means when entering or leaving the machine area.

2. The device of claim 1 including two pairs of hand grips extending horizontally outward from said horizontal bench on opposed sides thereof, a further set of hand grips vertically disposed on one of said horizontal bar elements (13).

3. The device of claim 2 wherein said weight means comprise a pair of upper and lower cross bars (7,28) interconnected by vertical bars (6) with each pair braced by plural transverse cross bars (38,32) thereby forming an open sided cage, plural pulleys disposed at the top and bottom of said cage having said cable means trained thereover, and a plurality of stacked weights within said cage, constrained to ride on a pair of rods fastened to upper and lower portions of said cage, said weights connected to the top pulleys through a rod extending through said weights having openings on said rod adapted to register with holes within said weights to lock therethrough with a locking pin (35).

4. The device of claim 3 wherein said cage is connected to said first grid by rod members (9) and diagonal braces (8) further support the cage on the rods (9).

5. The device of claim 4 in which one horizontal bench support bar remote from said cams interconnects with vertical legs (6) of said cage through support bars (5).

* * * * *